United States Patent [19]

Malick

[11] 4,056,798

[45] Nov. 1, 1977

[54] CURRENT LIMITING CIRCUIT BREAKER

[75] Inventor: Franklin S. Malick, Monroeville, Pa.

[73] Assignee: Westinghouse Electric Corporation, Pittsburgh, Pa.

[21] Appl. No.: 615,858

[22] Filed: Sept. 23, 1975

[51] Int. Cl.[2] ..... H01H 77/10

[52] U.S. Cl. ..... 335/16; 335/195; 335/201

[58] Field of Search ..... 335/6, 16, 38, 195, 335/201; 200/144 C, 147 R, 147 B

[56] References Cited

U.S. PATENT DOCUMENTS

| | | | |
|---|---|---|---|
| 2,167,499 | 7/1939 | Dickinson | 200/147 R |
| 2,240,623 | 5/1941 | Lindstrom | 200/147 R |
| 3,506,799 | 4/1970 | Ellsworth et al. | 200/147 R |
| 3,815,059 | 6/1974 | Spoelman | 335/16 |

*Primary Examiner*—George Harris
*Attorney, Agent, or Firm*—Robert E. Converse, Jr.

[57] ABSTRACT

A circuit breaker includes a slotted magnetic device having a plurality of spaced slotted conductive plates and a moving contact arm positioned within the slot when the circuit breaker is in a closed circuit position so that current flowing through the contact arm has a component in a vertical direction with respect to the slot. An overcurrent condition through the circuit breaker causes magnetic flux to be generated within the slotted magnetic device which develops a force to drive the moving contact arm from the front to the rear of the slot in a direction generally parallel to the bottom of the slot, thereby actuating the circuit breaker from a closed circuit position to an open circuit position. The circuit breaker also includes an arc-extinguishing device including a plurality of apertured conductive plates. The moving contact arm includes a probe member extending into the apertures of the plates when the circuit breaker is in a closed circuit position.

12 Claims, 9 Drawing Figures

CURRENT LIMITING CIRCUIT BREAKER

BACKGROUND OF THE INVENTION

1. Field of the Invention

The invention relates generally to electrical apparatus, and more particularly, to circuit breakers having current limiting capability.

2. Description of the Prior Art

Circuit breakers are widely used in industrial, commercial, and residential environments for protecting power distribution equipment against damage from overcurrent conditions. One measure of a circuit breaker is its current interrupting rating. This is defined as the highest value of available fault current which the circuit breaker can twice interrupt without suffering electrical or mechanical failure.

With the trend toward higher available fault currents, it is desirable to provide a circuit breaker with an increased current interrupting rating. This has traditionally been accomplished by using heavier components and by making the case of the circuit breaker larger and stronger so as to withstand the forces caused by high current operation. However, the space available for installation of circuit breakers is often limited, and it is desirable to increase the current interrupting rating while maintaining the same case size. This can be achieved by limiting the flow of current through the circuit breaker under fault conditions to a value less than the full available fault current. The amount of current flow through the breaker under these conditions is known as the let-through current.

If the speed of the breaker opening operation is increased, a higher arc voltage is produced in the first half cycle. This limits the peak let-through current and increases the current interrupting rating. One method of limiting the peak let-through current is to use magnetic forces generated by overcurrent conditions through the circuit breaker to rapidly force a movable contact arm away from the fixed contact. This method is used in the circuit breaker described in U.S. Pat. No. 3,815,059, issued June 4, 1974 to Leonard A. Spoelman and assigned to the assignee of the present invention. In this patent, a slotted magnetic device is disposed about the contact arm and generates sufficient magnetic flux upon overcurrent conditions to develop a force to draw the contact arm into the slot and separate the movable contact from the fixed contact. It is desirable to provide a more compact circuit breaker utilizing magnetic forces to provide improved current limiting action.

Arc extinction has been accomplished in previous circuit breakers by using a stack of spaced conductive plates to provide rapid arc extinction and prevent reignition of the arc after the first current zero. It is desirable to provide a circuit breaker including an arc extinguishing device which exhibits improved performance with no increase in size. It is also desirable to provide increased protection for the interior of the circuit breaker case by preventing the arc or hot gases generated by the arc from damaging components of the breaker operating mechanism.

SUMMARY OF THE INVENTION

In accordance with one embodiment of the invention, a circuit interrupter is provided comprising a pair of separable contacts; means supporting the contacts and operable to actuate the contacts between open and closed positions to interrupt current flow therebetween;

a magnetic drive structure comprising a magnetic device of magnetic material including a slot having an open top, a closed bottom, a front, and a rear; and a contact arm carrying one of the contacts and extending into the slot. The current flowing through the circuit breaker passes through the contact arm and includes a component of current flow in a vertical direction with respect to the slot. An overcurrent condition through the circuit breaker generates magnetic flux within the magnetic device to develop a force which drives the contact arm from the front of the slot to the rear of the slot in a direction generally parallel to the bottom of the slot, thereby effecting circuit interruption. The circuit breaker also includes an arc extinguishing structure comprising a plurality of spaced apertured conductive plates and a contact arm including a probe member which extends through the apertured plates when the contact arm is in a closed circuit position.

BRIEF DESCRIPTION OF THE DRAWINGS

The invention may be more readily understood by referring to the following detailed description of an embodiment thereof when read in conjunction with the accompanying drawings, in which.

DESCRIPTION OF THE PREFERRED EMBODIMENT

Figure 1:
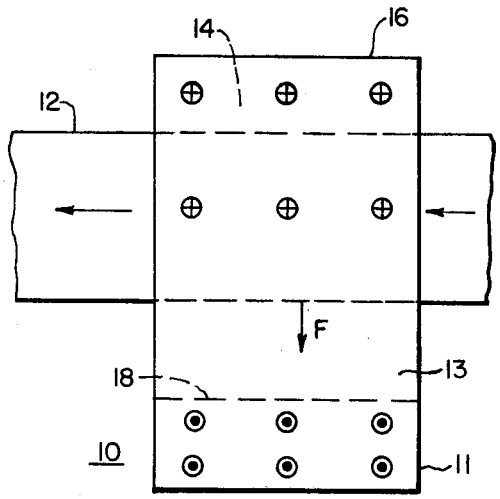
PRIOR ART FIG. 1.
FIG. 1 is a top diagrammatic view of a prior art magnetic device generating electrodynamic forces.

Throughout the drawings, corresponding reference characters refer to corresponding parts.

Figure 3:
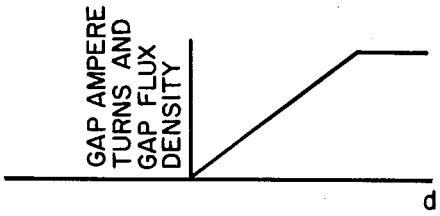
PRIOR ART FIG. 3.
FIG. 3 is a graph illustrating the magnetic flux distribution of the magnetic device of FIGS. 1 and 2.

In the aforementioned U.S. Pat. No. 3,815,059, a circuit interrupter is described which utilizes electrodynamic forces generated by an overcurrent condition to drive a movable contact arm to open the contacts of the interrupter. In FIG. 1, there is shown a diagram of a slotted magnetic device 10 as used in the aforementioned U.S. Pat. No. 3,815,059. The magnetic device 10 includes a yoke 11 and pole pieces 13 of iron forming a U-shaped channel or slot 14. Current is uniformly distributed in the conductor 12 which is, in effect, a single turn coil. The flux density of the magnetic field established in the slot 14 by this uniformly distributed current increases linearly proceeding from bottom to top across the conductor, as is shown in FIG. 3. The iron of the magnetic device 10 is assumed to have infinite permeability so that no magnetomotive force is needed to cause magnetic flux to flow in the iron. Since no magnetomotive force is required to make the flux flow from the point A to the point B in the iron, the magnetomotive force across the slot 14 at this point is zero, as shown in FIG. 3. The full ampere-turns provided by the conductor 12 thus appear across the slot at the top side of the conductor 12. The iron is a constant potential surface out to the top 16 of the slot 14 and the magnetomotive force across the slot 14 remains constant.

The flux density in the slot 14 is directly proportional to the magnetomotive force across the slot, since the slot is filled with air. Thus, the condition exists that a conductor carrying current is located in a magnetic field, i.e., the magnetic field that the current itself has produced. Such a conductor will have a force acting on it which causes the conductor to move across the field in a direction which will cause the total flux to become larger. The conductor 12 thus moves toward the bottom 18 of the slot because the area of the air gap with the maximum ampere turns across it becomes larger as the conductor 12 moves toward the bottom of the slot. The force which is developed is always perpendicular to the direction of the current flow. Thus, a force F is exerted upon the conductor 12, as is shown in FIG. 1, producing a slot motor effect.

Figure 2:
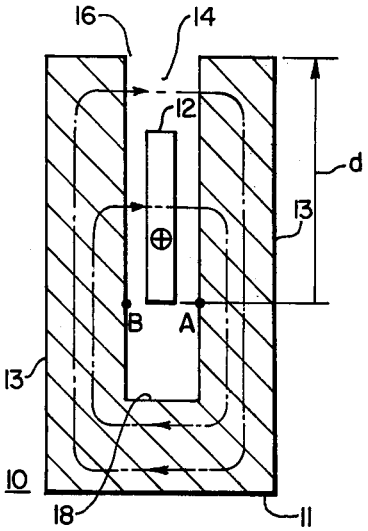
PRIOR ART FIG. 2.
FIG. 2 is a side diagrammatic view of the prior art magnetic device shown in FIG. 1.

Note that no flux crosses the slot in the area between conductor 12 and the bottom 18 of the slot 14, as shown in FIG. 2. All flux which crosses the slot 14 does so in the area of the conductor 12 and in the area of the slot 14 which is on the side of the conductor closest to the top 16 of the slot 14. This is important for an understanding of the present invention.

Figure 4:
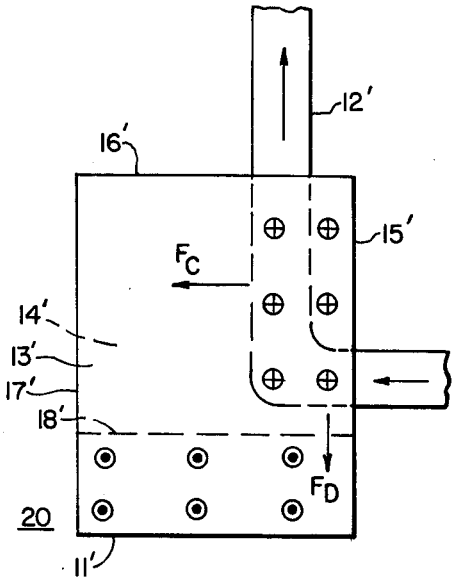
FIG. 4 is a top diagrammatic view of a magnetic device employing the principles of the present invention.

In FIG. 4, there is shown a diagram of a magnetic device 20 which employs the principles of the present invention. The device 20 includes a yoke 11', pole pieces 13', and a slot 14' having an open top 16', a closed bottom 18', a front 15' and a rear 17'. A current-carrying conductor 12' makes a right angle bend inside the slot 14'. The electromagnetic force which is developed by the interaction between the current flow in the conductor 12' and the magnetic flux generated by that current flow is always at right angles to the direction of the current flow. Since current flow in the conductor 12' has two components, one vertical and one horizontal, two slot motor forces are developed. One force $F_D$ is directed toward the bottom 18' of the slot 14', similar to the magnetic device 10 of FIGS. 1 and 2. The second force $F_C$ is generated by the vertical current component and is directed across the slot 14' from the front 15' to the rear 17'. Both of these forces obey the rule that motion caused by these forces must cause an increase in the total flux. If motion is permitted in the direction of $F_C$, then the conductor 12' will move across the slot from the front 15' to the rear 17'. The flux which crosses the slot is all in the area of the conductor 12' or in the area of the slot which is on the side of the conductor farthest from the bottom 18'. This flux completes its path through the iron of the yoke 11' as shown in FIG. 4. Since it is assumed that the magnetic device 20 is formed from perfect iron with infinite permeability, it makes no difference which path the flux takes to get from the air gap area (the area on the side of the conductor 12' farthest from the bottom 18') to the iron yoke area. The flux density will be uniform in the iron of the yoke 11'. In a practical magnetic device, the iron is laminated. Thus, some of the flux must cross from lamination to lamination in order to get to the area of the yoke 11' toward the rear 17' of the magnetic device. This will cause the iron at the bottom 18' of the magnetic device to saturate first but will not affect the magnitude of the forces appreciably before the iron is fully saturated.

Figure 5:
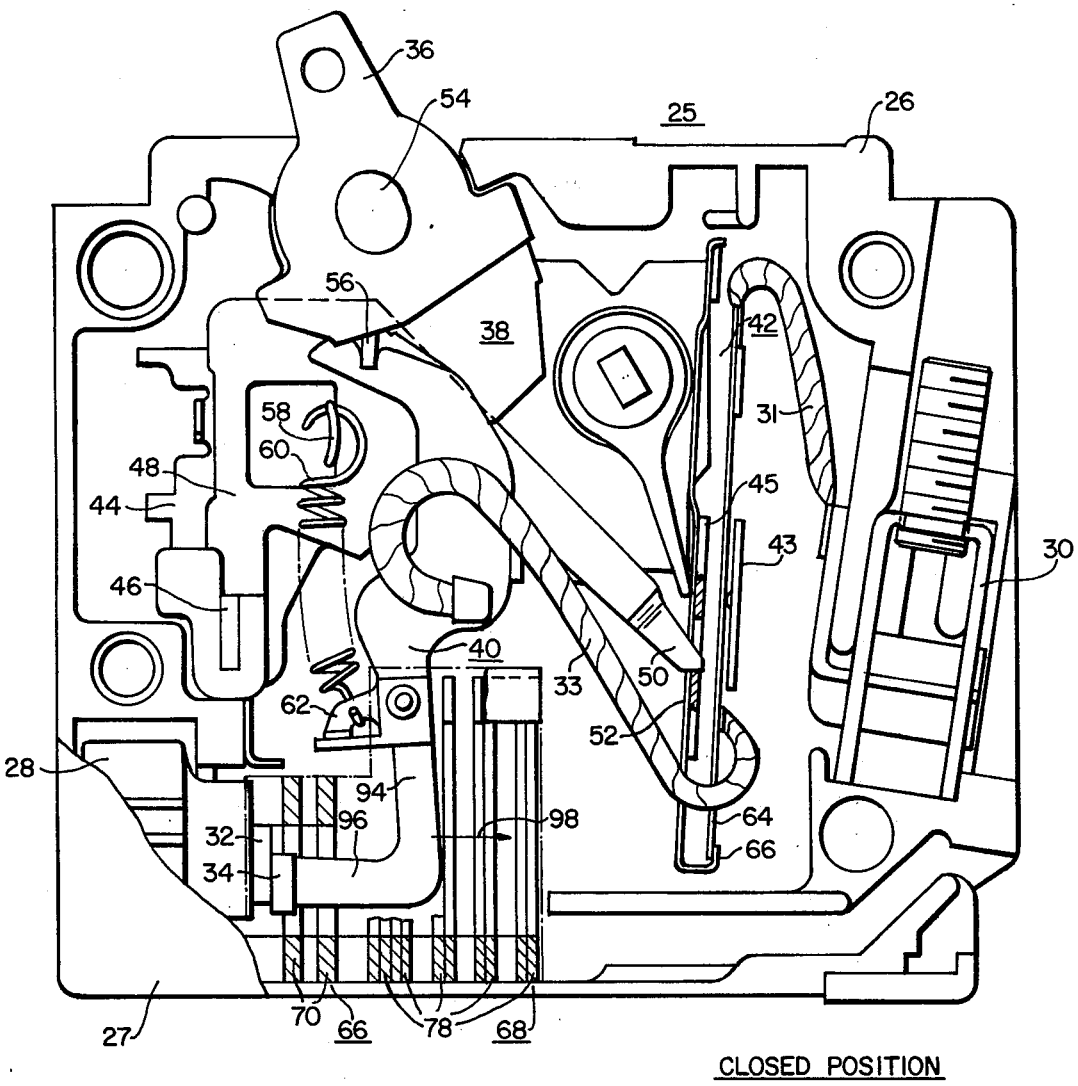
FIG. 5 is a side elevational view of a circuit breaker employing the principles of the present invention, shown partly in section, with the circuit breaker in a closed circuit position.

In FIG. 5 there is shown a molded case circuit breaker 25 employing a magnetic device of the type shown schematically in FIG. 4. The circuit breaker 25 includes an insulating case 26 into which are seated terminals 28 and 30 adapted for connection to an electrical circuit to be protected. An insulating cover 27, shown partially cut away in FIGS. 5–7, cooperates with the case 26 to enclose the breaker 25. Electrically connected to the terminal 28 is a fixed contact 32 which cooperates with a movable contact 34 mounted upon a probe member 96 of a contact arm 40. The terminal 30 is connected by a woven shunt 31 to one end of the trip assembly 42, the other end of which is connected by a woven shunt 33 to the contact arm 40. The current path through the circuit breaker 25 thus extends from the terminals 30 through the shunt 31, the trip assembly 42, the shunt 33, the contact arm 40, and the probe member 96 to the movable contact 34, the fixed contact 32 and the terminal 28.

Manual operation of a handle 36 actuates an operating mechanism shown generally at 38 which causes the contact arm 40 to move, thereby separating the contacts 32 and 34 and interrupting the electrical circuit connected externally to the terminals 28 and 30. The circuit breaker 25 also includes a trip assembly 42 which operates in a well known manner to automatically initiate separation of the contacts 32 and 34 upon overcurrent conditions through the circuit breaker 25.

Figure 6:
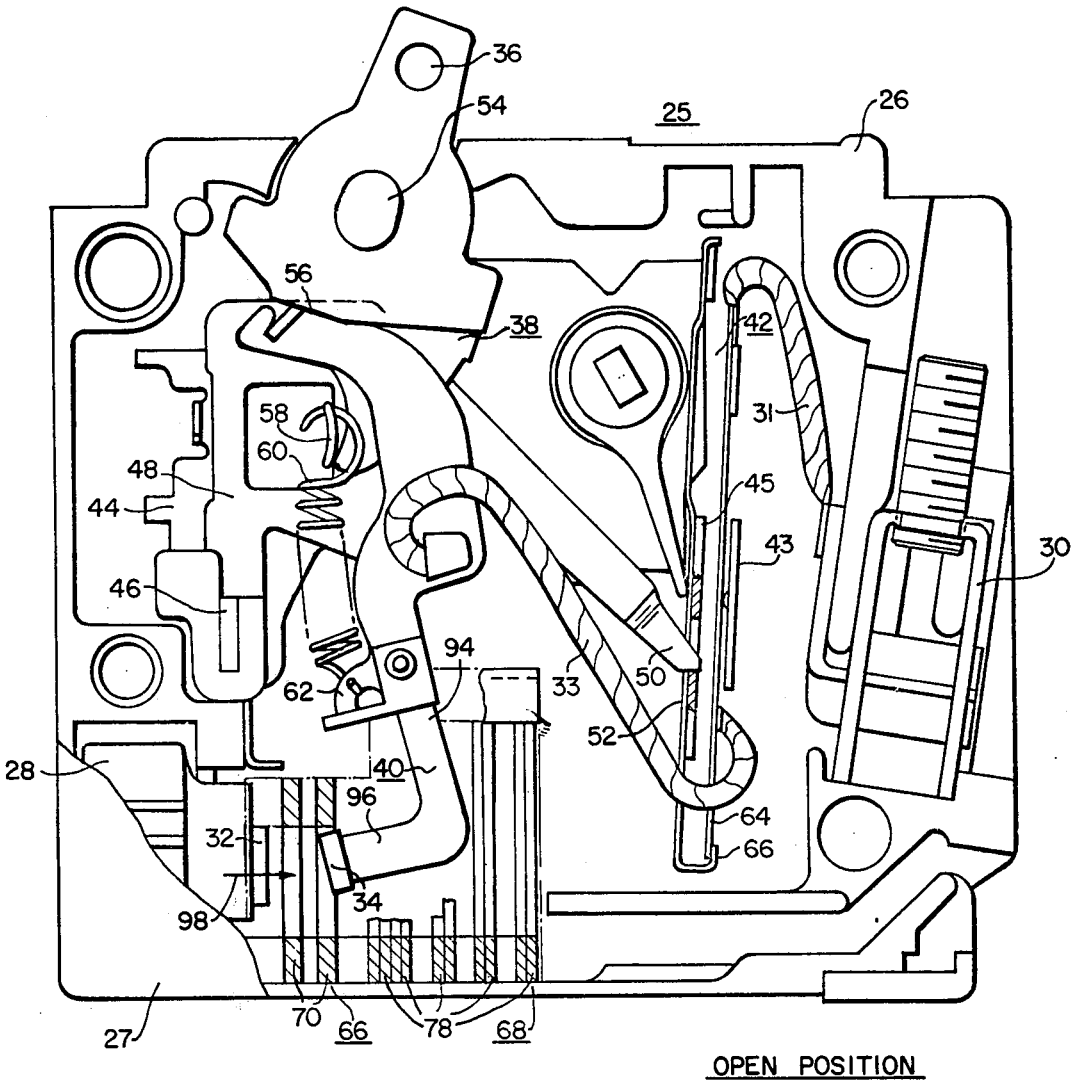
FIG. 6 is a side elevational view of the circuit breaker in FIG. 5, shown in the open circuit position.

The operating mechanism 38 is similar to the operating mechanism of the circuit breaker described in U.S. Pat. No. 3,110,786 issued Nov. 12, 1963 to Francis L. Gelzheizer and assigned to the assignee of the present invention. Thus, the operation of the operating mechanism 38 will not be described in detail. The operating mechanism 38 includes a metal frame 4 seated within the case 26. The frame 44 includes a bearing member 46 upon which is pivotally seated a cradle 48. One end of the cradle 48 forms a tongue member 50 which is releasably secured within an apertured latch 52 of the trip mechanism 42. The handle 36 rotates about trunnions 54 seated within recesses of the case 26 and cover 27, and includes a pivot tab 56. The cradle 48 includes a spring tab 58 to which is attached an operating spring 60. The other end of the spring 60 is attached by means of a spring eyelet 62 to the contact arm 40. When the circuit breaker is in the closed circuit position as shown in FIG. 5, the tension of the spring 60 causes the contact arm 40 to bear upward against the pivot tab 56 and produces a clockwise torque upon the contact arm 40 about the pivot tab 56 to force the movable contact 34 into engagement with the fixed contact 32. If the handle 36 is manually rotated clockwise from the position shown in FIG. 5 to the position shown in FIG. 6, the pivot tab 56 and upper end of the contact arm 40 are moved to the left past the line of action of the operating spring 60. The tension of the spring 60 causes the contact arm 40 to rotate in a counterclockwise direction as seen in FIGS. 5 and 6 with a snap action about the pivot tab 56, thereby rapidly separating the movable contact 34 from the fixed contact 32 and interrupting the circuit. During this operation, the cradle 48 remains in a fixed position since the tongue 50 is secured by the latch 52 of the trip assembly 42.

The trip assembly 42 is similar to the trip assembly described in the aforementioned U.S. Pat. No. 3,110,786 and will be only briefly described. The trip assembly 42 includes a bimetal member 64 electrically connected between the shunt 31 and the shunt 33. Thus, the bimetal element 64 is in the current path through the circuit breaker. Upon occurrence of a moderate overcurrent condition through the circuit breaker, the bimetal member 64 will heat, causing the lower end of the bimetal element 64 to flex to the right as shown in FIG. 5. This deflection causes the bimetal element to engage a hook-shaped projection 66 of the latch 52, pulling the latch 52 to the right and causing the tongue 50 of the cradle 48 to be disengaged from the latch 52. The tension of the operating spring 60 causes the cradle 48 to rotate in a clockwise direction as shown in FIG. 5 about the bearing member 46, moving the spring tab 58 to the right of a line connecting the pivot tab 56 and spring eyelet 62. This causes the contact arm 40 to rapidly rotate in a counterclockwise direction as seen in FIG. 5 about the pivot tab 56, separating the movable contact 34 from the fixed contact 32. After a tripping operation, the circuit breaker 25 is in the position shown in FIG. 7.

The trip assembly 42 includes a trip yoke 43 of magnetic material attached to the bimetal member 64. An armature 45 also of magnetic material is attached to the latch member 52. Upon occurrence of an overcurrent condition through the circuit 25 more severe than the previously mentioned moderate overcurrent condition, a magnetic field is generated which produces an attractive force between the trip yoke 43 and armature 45. The armature 45 and attached latch 52 are deflected to the right as seen in FIG. 5, causing the disengagement of the tongue 50 and separation of the contacts 32 and 34 in a manner similar to the previously described thermal tripping operation.

Figure 7:
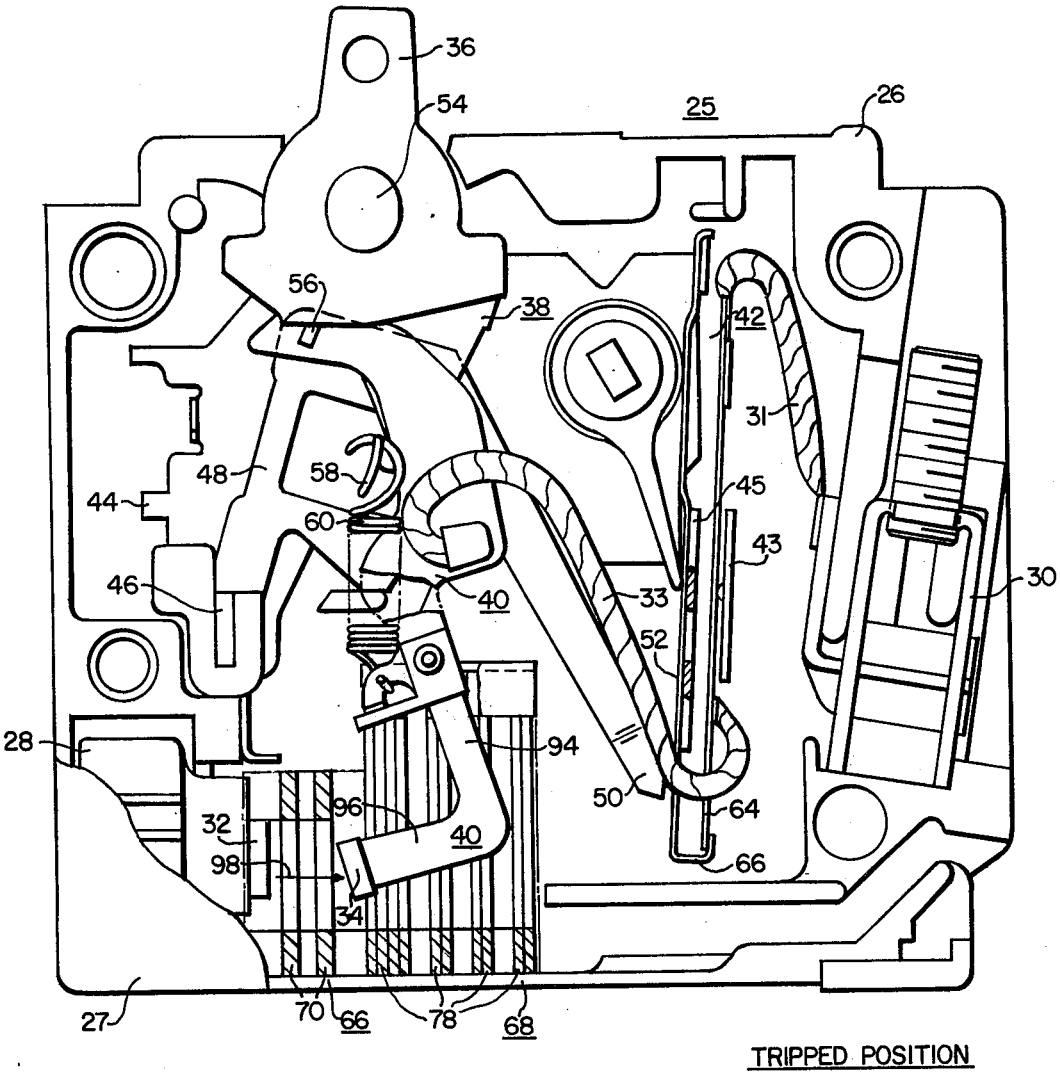
FIG. 7 is a side elevational view of the circuit breaker of FIGS. 5 and 6 shown in the tripped position.
Figure 8:
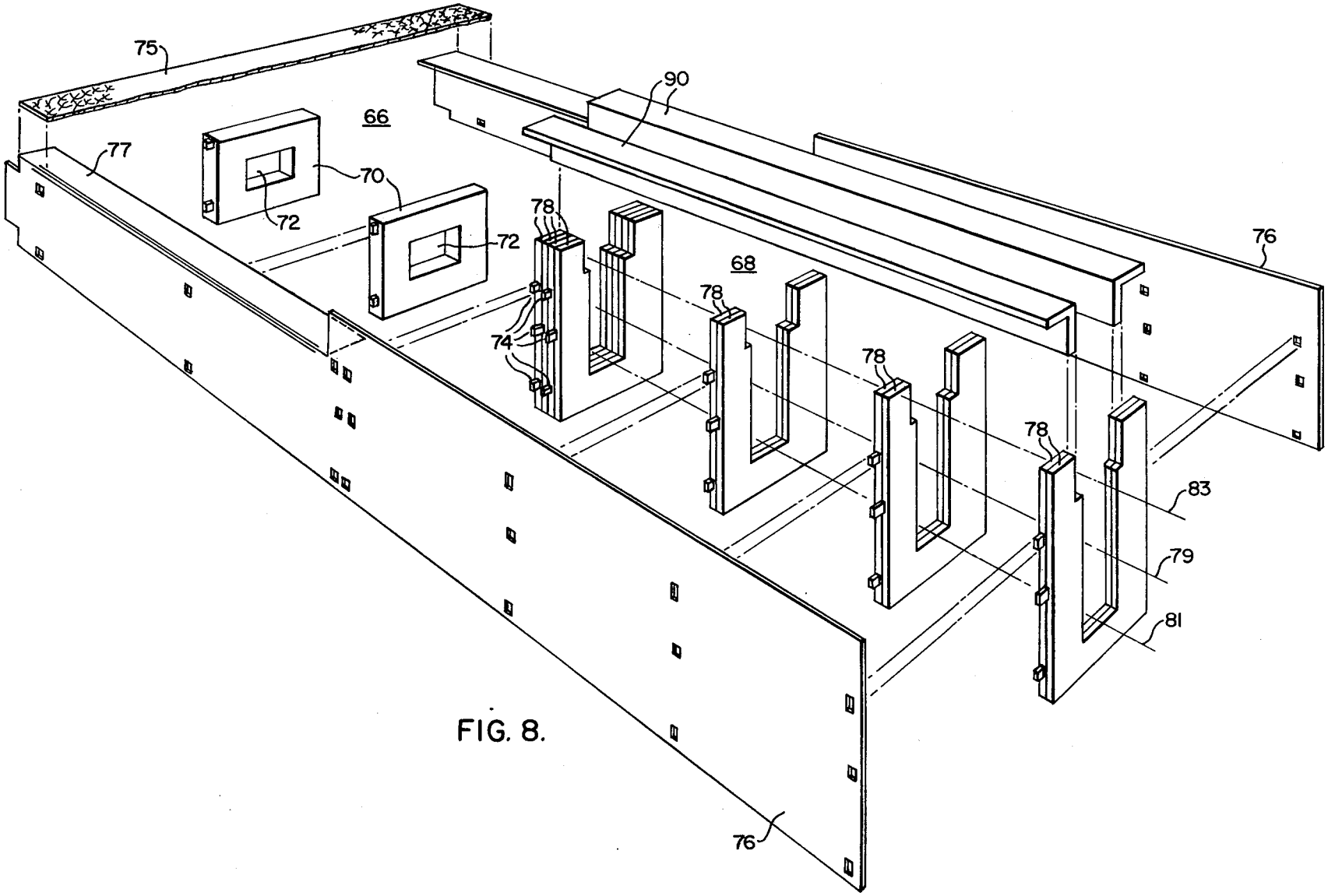
FIG. 8 is an exploded perspective view of the arc extinguishing device and slotted magnetic device of the circuit breaker of FIGS. 5 through 7.

The circuit breaker 25 includes an arc extinguishing structure 66 and a magnetic device 68 for producing electrodynamic forces to insure rapid separation of the contacts 32 and 34 upon a tripping operation. The arc extinguishing structure 66 and magnetic device 68 are shown in section in FIGS. 5 through 7, and in an exploded perspective view in FIG. 8. The arc extinguishing structure 66 comprises a pair of rectangular conductive plates 70, each plate having an aperture 72 therethrough. The magnetic device 68 comprises a plurality of U-shaped laminations 78 of magnetic material forming slot motor plates. As can be seen in FIGS. 5 through 7, pairs of laminations 78 are positioned in substantially parallel relationship, with unequal insulating gaps between the pairs of laminations 78. The U-shaped laminations 78 thus define an elongated slot 79 having a closed bottom 81 and an open top 83.

The arc extinguishing structure 66 and magnetic device 68 share common fiber spacers 76, thereby forming a unitary current-limiting structure. The plates 70 and U-shaped laminations 78 all include a plurality of seating tabs 74 which are positioned in corresponding receiving apertures of the spacers 76. Perpendicular portions 77 of the spacers 76 are folded over the top of the arc extinguishing plates 70 and are joined with a fiber shield 75. L-shaped insulating members 90 are glued into position over the open ends of the U-shaped laminations 78 and the seating tabs 74 secured within the apertures of the spacers 76 by staking.

As can be seen in FIGS. 5, 6 and 7, the contact arm 40 includes an upright member 94 and a probe member 96 to which the movable contact 34 is attached. When the circuit breaker 25 is in a closed circuit position as seen in FIG. 5, the probe member 96 extends through the apertures 72 of the arc extinguishing plates 70, allowing the movable contact 34 to engage the fixed contact 32 at the front of the slot 79. The upright member 94 is positioned within that portion of the slot 79 which is defined by the closely spaced laminations 78. Current flow through the upright member 94 of the contact arm 40 thus includes a substantial component in a vertical direction with respect to the slot 79. As was shown schematically in FIG. 4, this current flow generates magnetic flux within the magnetic device 68 which interacts with the vertical current flow to generate a force from the front to the rear of the slot 79. The direction of this force is shown in FIG. 5 by the arrow 98. The strength of this force during normal conditions of current flow below a predetermined magnitude is insufficient to overcome the tension force produced by the operating spring 60 which urges engagement of the movable contact 34 with the fixed contact 32. However, extreme overcurrent conditions above a predetermined magnitude, such as short circuit conditions, will cause the force 98 generated by the magnetic device 68 to overcome the force produced by the operating spring 60. The contact arm 40 will thus be thrown from the front toward the rear of the slot 79 in the direction of the force 98, causing counterclockwise rotation of the contact arm 40 about the pivot tab 56 and separation of the movable contact 34 from the fixed contact 32.

In order to generate maximum force, the slotted magnetic device should include as much iron or other magnetic material as possible. Thus, it would appear desirable to provide close spacing of the laminations 78 throughout the magnetic device. Improved performance is obtained, however, with the disclosed construction. When the circuit breaker is in a closed circuit position, the upright member 94 is in the region of the magnetic device 68 defined by the closely spaced laminations 78. Maximum force will thus be generated at the instant of separation. This is when a high initial acceleration is required in order to quickly bring the contact arm 40 from rest to a high velocity. Once the contact arm is moving, the high acceleration is no longer necessary. In fact, higher performance is obtained by providing the insulated gaps between the laminations 78 at the right of the magnetic device 68 as seen in FIGS. 5–7. This allows the laminations 78 to function as arc extinguishing plates as well as slot motor plates, since they will not form a conducting path in parallel with the arc.

When the movable contact 34 separates from the fixed contact 32, an arc is established therebetween. Current flow through this arc is sufficient to activate the magnetic tripping mode of the trip assembly 42 and initiate operation previously described. However, the rapid separation of the contacts 32 and 34 provides a correspondingly rapid increase in voltage across the arc, thereby limiting the peak let-through current. During the initial stages of contact separation, the arc established between the contacts 32 and 34 is enclosed by the arc extinguishing plates 70 of the arc extinguishing device 66. The arc impinges on the inner edges of the plates 70 which define the apertures 72, causing the edges of the plates to vaporize and absorb energy from the arc while confining the path of the arc to the area within the apertures 72. This energy absorption also increases the arc voltage, thereby providing additional current limiting action. The fiber shield 75 prevents the hot gases generated by the arc from passing upward into the region of the circuit breaker case 26 occupied by the operating mechanism 38.

Figure 9:
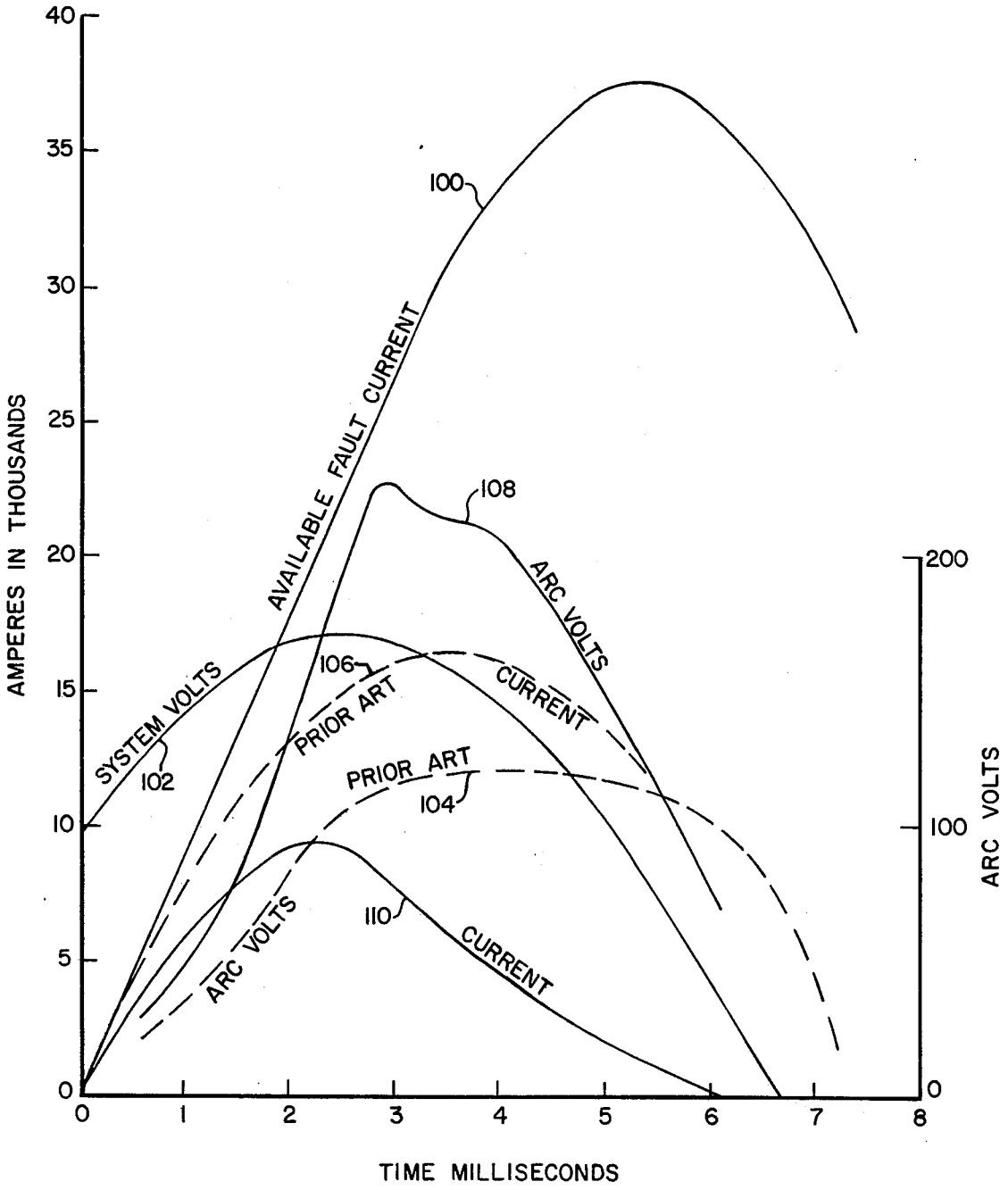
FIG. 9 is a graph showing the arc voltage and current flow through the circuit breaker of FIGS. 5 through 7 during a maximum current interruption test.

FIG. 9 shows the performance of the circuit breaker 25 when subjected to a short circuit test upon a supply circuit with an available fault current of 22,000 RMS amperes at 120 volts. The available fault current for the circuit is shown by the curve 100, while system voltage is shown by the curve 102. Curves 104 and 106 show the voltage across the arc and the let-through current, respectively, for a prior art circuit breaker having a case size identical to that of the circuit breaker 25 employing an arc extinguishing structure different from the arc extinguishing structure 66 of the present invention and without the magnetic device 68. Arc voltage and let-through current for the circuit breaker 25 shown in FIGS. 5 through 7 is indicated in curves 108 and 110, respectively. As can be seen, the peak let-through current for the circuit breaker 25 was only 9,400 amperes as compared to 16,300 amperes for the prior art circuit breaker. Correspondingly, the arc watt-seconds is reduced from 7,580 to 4,570, indicating less arc erosion damage inside the breaker. Comparison of curves 104 and 110 shows that the arc voltage rises much more rapidly for the circuit breaker 25 in comparison to the prior art circuit breaker, reaching 120 volts in 1.9 milliseconds, while the prior art breaker reaches 120 volts at 3.5 milliseconds. This rapid rise in arc voltage serves to reduce the peak let-through current through the circuit breaker under short circuit conditions.

The apertured arc extinguishing plates 70 insure that the path of an arc established between the separating contacts in the region of the stationary contact 32 will remain within an area defined by the apertures 72 of the plates 70. Thus, the arc will not jump to portions of the operating mechanism as was common in prior art circuit breakers. In addition, gases generated by the arc will be confined by the apertured plates 70 to areas not susceptible to damage therefrom. The magnetic device 68 provides rapid contact separation producing a rapid rise in arc voltage and a correspondingly limited peak let-through current. A circuit breaker could be constructed which includes either the magnetic device 68 or the arc extinguishing structure 66 along. Such a circuit breaker would provide improved performance over the prior art, but not to the degree exhibited by the described embodiment. Thus, it can be seen that the invention provides a compact circuit breaker with increased current interrupting capability which is less susceptible to damage when interrupting circuits under extreme high current conditions, thereby extending the useful life of the breaker.

While the principles of the present invention are particularly suited for application in small molded case circuit breakers, they are not so limited, but may be applied to other types and sizes of circuit breakers. Numerous other changes may be made in the above construction and different embodiments of the invention may be made without departing from the spirit and scope thereof. Thus, it is intended that all subject matter contained in the foregoing description or shown in the accompanying drawings shall be interpreted as illustrative and not in a limiting sense.

I claim:

1. A circuit interrupter, comprising:

a pair of separable contacts;

means supporting said separable contacts and operable to actuate said contacts between open and closed positions to interrupt current flow therebetween; and a magnetic drive structure comprising a magnetic device comprising a plurality of slotted plates of magnetic material forming an elongated slot having a top and a bottom, said slotted plates being electrically insulated from each other and being spaced apart at unequal intervals to form a plurality of insulating gaps;

said supporting means comprising a contact arm carrying one of said contacts and extending into said slot when said contacts are in a closed circuit position;

the current through said circuit interrupter when in a closed circuit position passing through said contact arm and including a component of current flow in a vertical direction with respect to said slot;

an overcurrent condition through said circuit interrupter above a predetermined value generating magnetic flux in said magnetic device to produce a force acting on said contact arm to separate said contacts.

2. A circuit interrupter as recited in claim 1 wherein the portion of said contact arm carrying said vertical component of current flow is located, when in a closed circuit position, within said slot in a region in which said slotted plates are closely spaced relative to other regions of said slot.

3. A circuit interrupter, comprising:

a pair of separable contacts;

means supporting said separable contacts and operable to actuate said contacts between open and closed positions to interrupt current flow therebetween;

a magnetic drive structure comprising a magnetic device having a slot therein, said slot having an open top and a closed bottom; and a contact arm carrying one of said contacts and extending into said slot when said contacts are in a closed circuit position;

said separable contacts engaging each other at a point closer to the closed bottom of said slot than to the top, the current flow through said circuit interrupter when in a closed position passing through said contact arm and said engaged contacts so as to include a substantial component of said current flow in a vertical direction with respect to said slot;

an overcurrent condition through said circuit interrupter above a predetermined value generating magnetic flux in said magnetic device to produce a force acting on said contact arm to separate said contacts.

4. A circuit interrupter as recited in claim 3 wherein said magnetic device comprises a plurality of slotted plates of magnetic material forming an elongated slot.

5. A circuit interrupter as recited in claim 4 wherein said slotted plates are electrically insulated from each other and are spaced apart to form a plurality of insulating gaps.

6. A circuit interrupter as recited in claim 5 wherein said slotted plates are spaced at unequal intervals.

7. A circuit interrupter as recited in claim 6 wherein the portion of said contact arm carrying said vertical component of current flow is located, when in a closed circuit position, within said slot in a region in which said slotted plates are closely spaced relative to other regions of said slot.

8. A circuit interrupter as recited in claim 3 further comprising an arc-extinguishing structure supported in proximity to said contacts to effect extinction of an arc drawn between said contacts during an opening operation of said circuit interrupter.

9. A circuit interrupter as recited in claim 8 wherein said arc-extinguishing structure comprises a plurality of spaced arc-extinguishing plates disposed about a path defined by said arc so as to absorb energy from said arc.

10. A circuit interrupter as recited in claim 9 wherein said arc-extinguishing plates are formed from electrically conductive material.

11. A circuit interrupter as recited in claim 10 wherein said arc-extinguishing plates comprise means defining a plurality of apertures and said contact arm comprises a probe member extending through said apertures when said contact arm is in a closed circuit position.

12. A circuit interrupter as recited in claim 11 further comprising insulating positioning means engaging said arc-extinguishing plates and said slotted plates in spaced relationship to form a unitary current limiting structure.

* * * * *